United States Patent [19]

Frankie

[11] 4,304,493

[45] Dec. 8, 1981

[54] SAND MIXER

[76] Inventor: Donald M. Frankie, 1599 Gull La., Mound, Minn. 55364

[21] Appl. No.: 120,824

[22] Filed: Feb. 12, 1980

[51] Int. Cl.[3] ..... B28C 5/14; B28C 7/04

[52] U.S. Cl. ..... 366/20; 222/135; 366/34; 366/35; 366/37; 366/64; 366/158; 366/162; 366/181

[58] Field of Search ..... 366/16, 19, 20, 21, 366/30, 33, 34, 35, 37, 40, 64, 156, 158, 162, 181; 222/135, 144.5

[56] References Cited

U.S. PATENT DOCUMENTS

| | | | |
|---|---|---|---|
| 2,863,651 | 12/1958 | McBride | 366/19 X |
| 3,070,858 | 1/1963 | Deacon | 366/17 X |
| 3,294,287 | 12/1966 | Went | 366/156 X |
| 3,682,448 | 8/1972 | Kedzior et al. | 366/6 |
| 3,746,313 | 7/1973 | Weeks et al. | 366/19 |
| 3,885,774 | 5/1975 | Harris et al. | 366/20 |
| 4,039,169 | 8/1977 | Bartholomen | 366/64 X |
| 4,140,246 | 2/1979 | Frankie | 222/135 X |

*Primary Examiner*—Philip R. Coe

*Attorney, Agent, or Firm*—Schroeder, Siegfried, Ryan, Vidas, Steffey & Arrett

[57] ABSTRACT

A foundry sand mixer for mixing and dispensing silica or green sand and their additives through the enclosed longitudinal belt conveyor mechanism having a plurality of openings in the top communicating with a first feeder disposed above the enclosed longitudinal belt conveyor mechanism and including a pair of openings in the bottom. The first feeder includes an auger-type conveyor and a sand weir communicating with the most upstream opening in the first feeder. A first hopper for containing silica sand and a second hopper for containing green sand are disposed over the first feeder. A selective valve is disposed at the bottom of each of the first and second hoppers permitting the flow of sand through only one of the hoppers at any time or preventing the flow of any sand from the hoppers. The mixer may include additional feeders, some of which are disposed above and downstream from the first feeder, and others including pumps are connected to a plurality of fluids that are fed through a constant speed mixer where the materials are mixed and the mixed materials delivered at a discharge opening.

8 Claims, 6 Drawing Figures

SAND MIXER

This invention relates to the field of mixers and more particularly to the field of foundry sand mixers for mixing silica or green sand and their additives.

BACKGROUND OF THE INVENTION

While the art of mixing foundry sand per se through a mechanical process is generally known, there are attendant problems in attempting to use the same equipment for mixing green sand and its additives as generally might be used in a mixer using silica sand and its additives. Because of the inherent differences in the materials to be mixed and passed through the machine, the practice has generally been to use separate machines for each of the different foundry sand materials and processes.

SUMMARY OF THE INVENTION

The embodiments of this improvement invention makes it possible to combine the necessary equipment into a single machine to mix either green sand or silica sand and their additives.

Various means have been attempted to mix green sand which requires the addition of such other granular and dry ingredients as fire clay, bentonite, sea coal, pitch, wood flour and the like, along with an appropriate mixture of water. On the other hand, silica sand, which may also be known as a "no-bake" sand, is generally mixed with dry granular materials such as chromite and ferric oxide and several liquid ingredients which may include certain chemicals. Because certain green sand molds may be broken down after use and reused, green sand, when mixed with such components, provides a different flow pattern than that of silica sand. Silica sand flows through hoppers and equipment much like the flow of water whereas green sand has additional additives and mixtures that generally make it lumpy with attendant flow problems.

Various means have been devised in the past to make a slurry of the additives and add them to the green sand but the mechanism does not prove to be useful in working with both types of molding sand. One such mechanism is that disclosed in U.S. Pat. No. 3,070,858 issued to J. S. Beacon.

It is also known that certain silica sand or "no-bake" sand mixers have been available but are not operable to run green sand through them and mix the green sand in the manner generally attributable to silica sand. One such disclosure of a mechanism of this type is found in U.S. Pat. No. 3,682,448 isued to Kedzior et al.

The present invention is an improvement upon the mechanism disclosed in my earlier U.S. Pat. No. 4,140,246 entitled PROPORTIONAL CONTROL SYSTEM FOR FOUNDRY SAND MIXING DEVICE.

It is therefore a general object of the present invention to provide an improvement in foundry sand mixing equipment.

It is a more specific object of this invention to provide a foundry sand mixer that will mix either silica sand or foundry green sand and their additives.

It is yet another object of this invention to provide a foundry sand mixer in which either silica sand or foundry green sand is controlled by a valve mechanism selectively depositing one or the other on a belt conveyor for proper mixing.

These and other objects and advantages of the invention will more fully appear from the following description, made in connection with the accompanying drawings, wherein like reference characters refer to the same or similar parts throughout the several views, and in which:

FIG. 5 is a schematic diagram of the selective sand valve.

PREFERRED EMBODIMENT

Figures 1, 3:
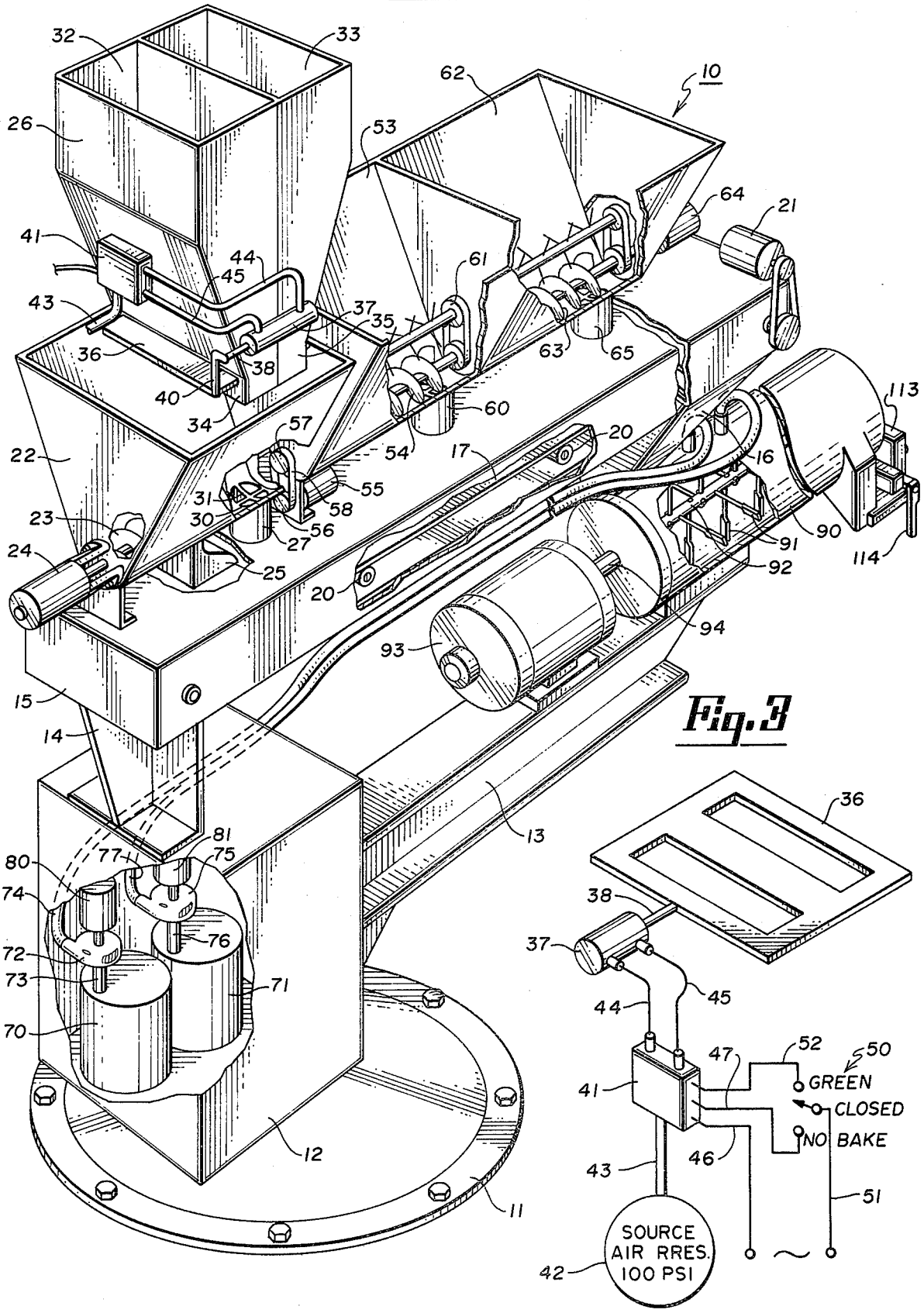
FIG. 1 is a perspective view of the invention.

Reference is now made to FIG. 1 wherein the foundry sand mixer 10 is disclosed. The mixer is secured to a base 11 that has a vertical axis about which a housing 12 pivots, housing 12 having a cantilever beam 13 extending radially therefrom. At the upstream end of the mechanism, a bracket 14 supports one end of an enclosed conveyor mechanism 15 and the other end of conveyor mechanism 15 is supported by a chute 16 that acts as a support bracket that is indirectly secured to beam 13.

A belt conveyor 17 is disposed within the housing 15 and is supported for movement by a plurality of horizontal transversely oriented rollers 20. A direct current drive motor 21 is connected to the downstream end roller to drive the belt conveyor mechanism 17.

Disposed above the enclosed conveyor 15 is a first feeder 22 which is elevated slightly above the conveyor enclosure 15. Feeder 22 is in the nature of a container having sloping sides converging at the bottom with an auger-type conveyor 23 driven by a variable speed motor 24. Feeder 22 has its sides extending upwardly at an angle of approximately 30 degrees with a vertical and it has been found that if the sides extend outwardly so that the angle with the vertical is approximately 45 degrees, flow of the green sand will be encumbered. Feeder 22 has two openings in the bottom thereof, the first terminating in a sand weir 25 which is at the upstream location with respect to the longitudinal dimension of the feeder and is directly beneath a silica sand hopper 26. Disposed downstream from said weir 25 is a tubular member 27 that communicates between an opening 30 in the bottom of first feeder 22 and the top of the enclosed conveyor mechanism 15. Disposed across the opening 30 is a scarifier 31 in the nature of two right angle diametrically oriented rods that are used to break up any lumps that may still exist upon being conveyed to that opening by auger conveyor 23.

Silica sand hopper 26 is disclosed as being generally rectangular in shape having a common side 32 which acts as a separator with another hopper 33 that is used to contain green sand. The sides of the hoppers slope downwardly in a converging manner and are terminated in a pair of chutes 34 and 35.

A selective valve 36 is disposed across the openings of chutes 34 and 35 so that upon movement to the right (as seen in FIG. 1) sand will flow from hopper 26 through chute 34 into first feeder 22 but block flow of sand through chute 35 and upon movement to the left, valve means will permit flow of green sand from hopper 33 through chute 35 but block the movement of silica sand. In other words, either silica sand or green sand is admitted during the two extreme movements and while the valve is in its center position, sand is restricted from movement into either chute 34 or 35. Selective valve 36 is controlled by an air cylinder 37 that has a piston rod 38 connected to valve 36 through a linkage 40.

A solenoid actuated valve 41 is connected to a source of pressurized air 42 through a pneumatic line 43. The source of air under pressure is generally 100 psi for good operating conditions.

A pair of pneumatic lines 44 and 45 connect solenoid valve 41 with air cylinder 37 and the solenoid coils are controlled through an electrical circuit connected to the solenoid valve 41. A 110 volt source is connected through a common lead 46 to solenoid valve 41 and one coil has its return current path through a conductor 47 and one terminal of a single pole double throw switch 50. The switch blade is connected to the other terminal of the 110 volt source through a conductor 51. Another coil in the solenoid valve 41 is connected through the electrical circuit by a conductor 52 connected to another terminal of switch 50. As disclosed in FIG. 5, when the switch blade is connected with conductor 47, the silica sand or "no-bake" sand is permitted to pass through valve mechanism 36 and when the other portion of the solenoid valve is actuated through conductor 52, the green sand is permitted to pass through valve 36.

A second feeder 53 is disposed above the conveyor enclosure 15 downstream from first feeder 22. Second feeder 53 has the same general shape and configuration as that of first feeder 22 and includes a conveyor auger 54 driven by a variable speed motor 55 through a pair of sprockets 56 and 57 and a chain 58. Second feeder 53 has an opening in its bottom near the downstream end of auger conveyor 54 which is coupled to the housing 15 through a tubular member 60.

Disposed above the auger conveyor 54 is a stirrer 61 that is in the form of shaft extending parallel to the shaft of the auger conveyor 54 and having a plurality of branches or arms extending therefrom, which when the assembly is turned tends to break up any bridges or lumping of materials such as bentonite or sea coal. A pair of sprockets and a chain drive stirrer 61 form the shaft of auger conveyor 54.

A third feeder 62 is disposed downstream from second feeder 53 and is generally identical for the most part to that of second feeder 53. Feeder 62 also contains an augur-type conveyor 63 driven by variable speed motor 64 with a tubular section 65 connecting the opening in the bottom of the feeder through an opening in the top of conveyor housing 15.

Disposed at the bottom of the housing or compartment 12 is a pair of liquid containers 70 and 71 which may contain chemicals or may contain water, depending upon the type of additive to be made to the particular sand which is being mixed. Container 70 is connected to a pump 72 through a pipe 73 communicating with container 70 and an outlet line 74 is connected to pump 72. In a similar manner, a pump 75 is connected to fluid in container 71 through a pipe 76 and the outlet of pump 75 is dispensed through a pipe or line 77. A pair of variable speed motors 80 and 81 is respectively connected to pumps 72 and 75 to dispense the liquids contained in containers 70 and 71.

The variable speed motors described are conventional variable speed direct current motors and are generally ¾ H.P. in size. Air cylinder 37 is approximately one and one-half inches in diameter and has a six inch stroke and is manufactured by Lynair under Model No. AB102-6 whereas the solenoid valve 14 is of the type manufactured by Novi, Model 25C4E.

A cylindrical mixer 90 is secured to beam 13 by suitable means and has a plurality of paddles 91 carried by a shaft 92 that does the actual mixing. Shaft 92 is connected to a constant speed motor 93 by suitable means such as a coupling or clutch. Chute 16 receives materials from conveyor 17 through an opening formed in the downstream end beyond the end of conveyor 17. The lower end of chute 16 opens into a segment of mixer 90 at the upstream side thereof. Fluid-carrying pipes 74 and 77 are also connected to mixer 90 near the downstream side of the mixer.

Figure 2:
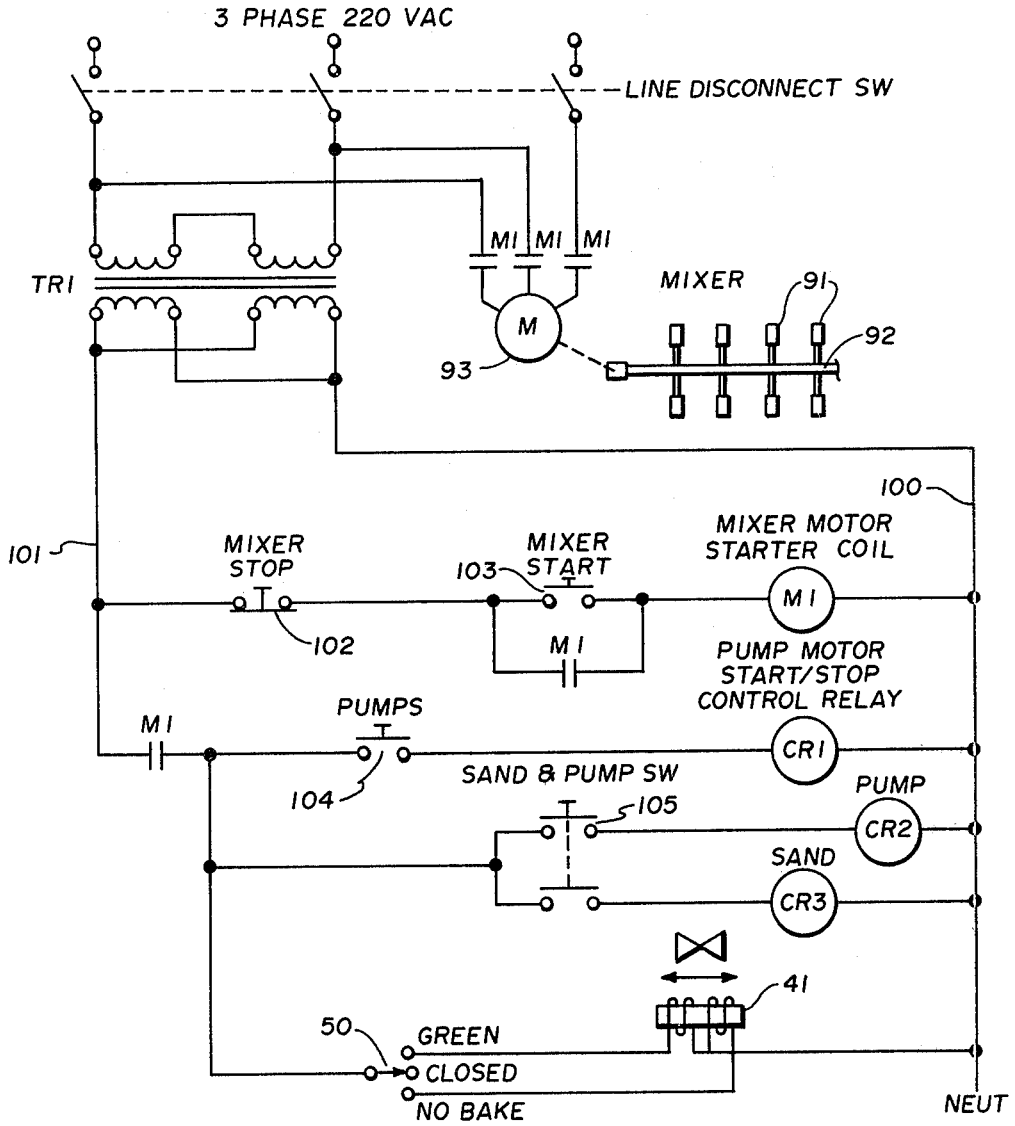
FIG. 2 is a schematic diagram of the mixer control circuit.
Figure 4:
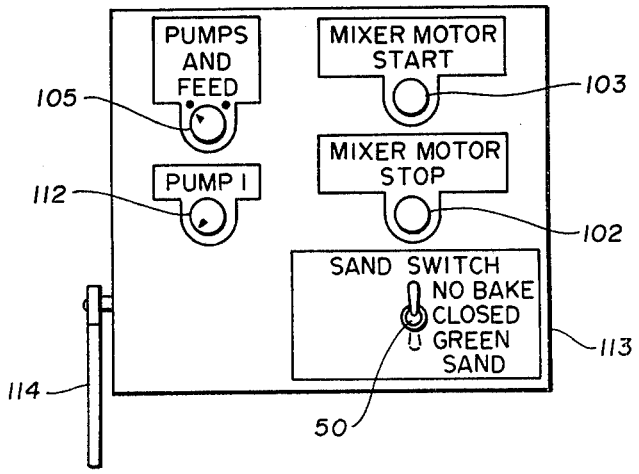
FIG. 4 is a diagram of the control panel on the end of the mixer.

In FIG. 2, the mixer motor drive circuit is disclosed in which a three phase 220 volt power line applies power through lines L1, L2 and L3 to mixer motor 93 through three relay contacts, all designated mixer starter contacts M1. The 220 volt line is connected to a transformer TR1 where a voltage reduction takes place in the secondary and 110 volt single phase alternating current is obtained and is applied to one line as a common or neutral line 100. A mixer motor relay M1 has its coil connected between line 100 and another line 101 connected to the secondary of transformer TR1 through a normally closed Mixer Stop pushbutton switch 102 and a normally open Mixer Start switch 103. In parallel with switch 103 is another pair of normally open relay contacts M1.

Electrical line 101 is extended in a parallel path through another set of relay contacts M1 which are closed upon depressing start switch 103 and upon depressing another normally open pushbutton switch 104 current is applied to a pump motor start relay CR1 that is also connected to neutral line 100. Upon pulling the switch button for switch 104, the circuit is opened. In parallel with switch 104 and control relay CR1 is another normally open double pole pushbutton switch identified as a SAND AND PUMP SWITCH 105, and upon closing connects another control relay CR2 with neutral line 100. Another control relay CR3 is connected in parallel with control relay CR2 through the second set of contacts in switch 105. Control relay CR2 is used to energize all of the pump circuits and control relay CR3 is used to energize all of the feeders that are used to supply additives by the feeders.

At the bottom of the circuit is shown the sand selector switch 50 that is connected to the solenoid coil of solenoid valve 41, causing the valve to be actuated and apply fluid under pressure to the cylinder to cause the movement of valve 36.

Figure 3A:
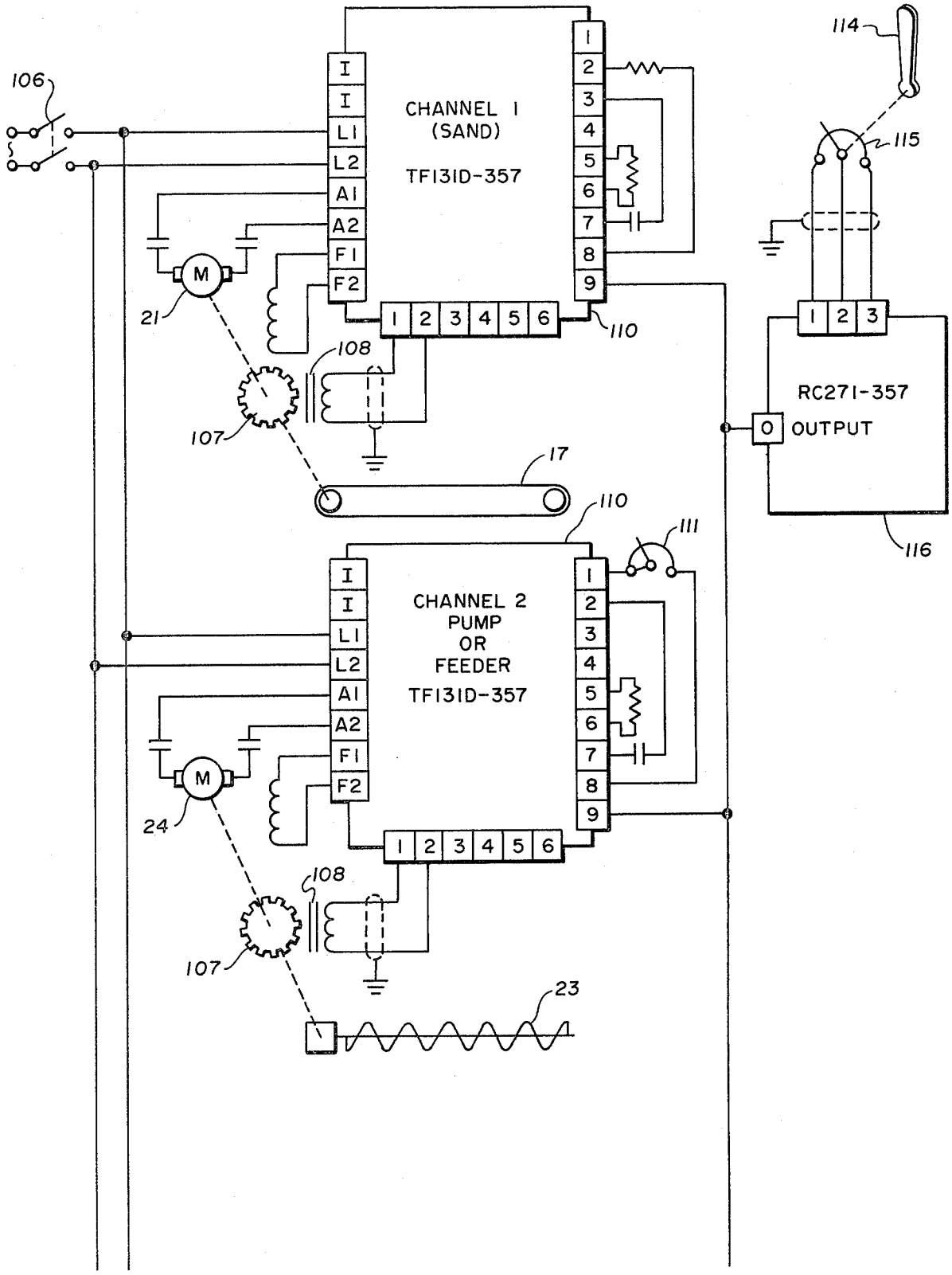
FIGS. 3A and 3B are schematic diagrams of the drive circuits for all of the variable speed motors driving feeders and pumps in the invention.
Figure 3B:
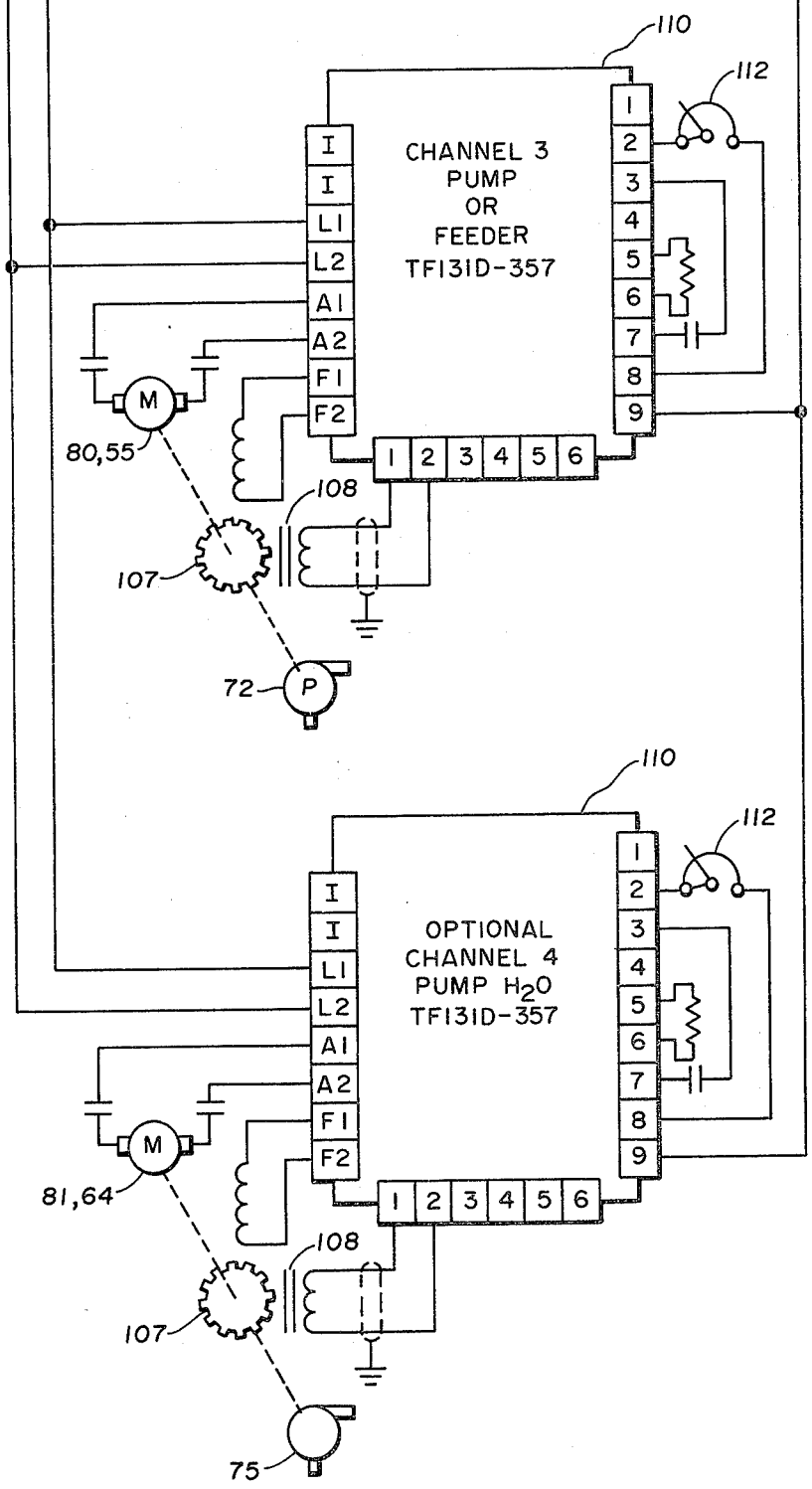

Turning now to FIGS. 3A and 3B, the electrical schematic of the variable speed drive motors will now be described. Alternating current of 230 volts single phase is applied through a switch 106 to each of the different mechanisms that may be in addition to the belt conveyor, feeders or pumps. A discussion of a portion of the circuit will be germain to the remainder where the various circuits and variable speed drive mechanisms are substantially identical to each other. Power is applied to channel 1 and the circuit in association with motor 21. The variable speed drive has a feed back circuit which works through a toothed wheel 107 that is sensed by a magnetic sensor 108 and the signal supplied to the circuit board 110. Circuit board 110 also has the field connections for the motor connected thereto as well as the armature connections through appropriate relay contacts identified as the relays shown in FIG. 2.

Circuit board 110 is further identified as a TF131D and is a tachometer follower speed control identified with that part number and available from Detection Sciences, Inc. of 2165 Cheshire Lane North, Minneapolis, Minn. The tachometer follower motor speed control is a digital closed loop operation in which the speed command is obtained in the form of a pulse train generated by a frequency control signal that enters the circuit on terminal number 9. Feedback of the follower motor speed is obtained from magnetic pickup 108 which senses the speed of the motor to be compared and if the pulse train rates differ from a set ratio, then an error signal is generated and voltage to the motor armature is changed to increase or decrease the motor speed. The ratio may be changed through the use of a variable resistor connected between terminals 1 and 8 but the external resistance is fixed for the conveyor 17, thus producing a fixed speed unless the pulses received at input 9 change the conveyor mechanism speed.

Another circuit board 110 is connected in a similar manner to motor 24 except that the fixed resistor connected between terminals 1 and 8 is changed and in its place, a 1,000 ohm variable resistor 111 is substituted in its place so that the speed relationship of motor 24 may be varied independently of the operation of motor 21. Thus the feed auger conveyor 23 may be operated at different speeds by comparison to the speed of motor 21.

It will of course be evident that the other circuit boards 110 are similar to that described previously, along with the attendant speed sensors through the use of the toothed wheel 107 and magnetic sensor 108. It will also be understood that motors 80 and 81 could be replaced by motors 55 or 64, depending upon whether a dry additive was to be used or a chemical. Therefore, the drive motors have been identified in an alternate manner in FIGS. 3A and 3B. It is also desirable in some instances to have a variable speed resistor 112 at a convenient location so that the operator may adjust the same from a control panel 113 where such liquids as water are critical in a green sand mix.

It will also be desirable on certain occasions to change the speed of all of the mechanisms without losing the speed relationship established through the use of the speed adjust potentiometers such as 111 and 112. Therefore, a speed control arm 114 is secured to another 1,000 ohm speed control potentiometer 115 that is connected to an oscillator circuit 116 that is shown in a simplified form and identified further as part No. RC271-357 manufactured by Detection Sciences, Inc. at 2165 Cheshire Lane North, Minneapolis, Minn. The module makes use of a voltage controlled oscillator which provides an output frequency that is proportional to a voltage input of zero to 5 volts DC. The voltage controlled oscillator takes its 0–50 DC input signal from a precision potentiometer 115 that is used to trim the five volt power supply of the circuit. This trimmed five volt output signal appears at terminal 9 and is applied to each of the circuit boards 110 identified previously. Thus the circuit can then be used to provide synchronous motor speed trim capability by the adjustment of a single potentiometer 115.

It must be noted that it is not possible to simply interchange the silica sand and green sand in hoppers 26 and 33 because the green sand, as stated previously, quite often is mixed with the materials which were formed into a mold and broken into parts and dumped back in the hopper. Because the silica sand flows much like water, weir 15 is needed to make an even layer or spreading of the sand on conveyor belt 17 whereas green sand would plug up the weir and has not proved successful in attempts to use the same mechanism as used for silica sand. Additionally, it has been found that where the auger-type conveyors 23, 54 and 64, are in use, if they have a six inch diameter, the port at the bottom of the feeder which opens into the tubular sections 27, 60 and 65 should be approximately 5 inches in diameter to give a proper flow of materials onto the belt conveyor 17.

By providing means to break up the green sand and permitting it to travel further in the bottom of the first feeder 22, it has been found that a successful operation will take place in dispensing the green sand into the enclosed conveyor 15.

It will, of course, be understood that various changes may be made in the form, details, arrangement and proportions of the parts without departing from the scope of the invention which consists of the matter shown and described herein and set forth in the appended claims.

What is claimed is:

1. In a foundry sand mixer for mixing and dispensing silica or green sand and their additives, the combination comprising:

(a) a support frame pivotal about a vertical axis and having a platform extending radially therefrom;

(b) an enclosure including an enclosed longitudinal belt conveyor mechanism extending above said platform and having a plurality of openings in the top of the enclosure communicating with said belt conveyor mechanism;

(c) first feeder means disposed above and at the most upstream location of said enclosed longitudinal belt conveyor mechanism, said first feeder means having a bottom and converging sloping sides communicating near the bottom with an auger-type conveyor, and having a pair of openings longitudinally separated in the bottom thereof feeding said belt conveyor;

(d) a sand weir communicating with the most upstream opening of said pair of openings in said first feeder means, said sand weir disposed above said longitudinal belt conveyor mechanism for dispersing sand on said belt conveyor mechanism;

(e) a first hopper for containing silica sand disposed over the upstream portion of said first feeder means;

(f) a second hopper for containing green sand disposed downstream from said first hopper and over said first feeder means;

(g) selective valve means disposed at the bottom of each of said first and second hoppers permitting the flow of sand through only one of said hoppers at any time or preventing the flow of any sand from said hoppers;

(h) and control means operably connected to said selective valve means for selecting one of said two sands or neither to be dispensed onto said belt conveyor.

2. The structure set forth in claim 1 including:

(i) a plurality of second feeder means disposed above said belt conveyor mechanism and at a downstream location from said first feeder means, each of said plurality of second feeder means having a bottom and converging sloping sides communicating near the bottom with an auger-type conveyor and having an opening in the bottom thereof feeding said belt conveyor;

(j) a constant speed mixer disposed on said platform and arranged to receive granular and liquid materials, mix the materials and deliver the mixed materials at a discharge opening, said belt conveyor communicating with said mixer;

(k) and a plurality of pump means connected to a plurality of fluids and communicating with said mixer.

3. The structure set forth in claim 2 including:

(l) a plurality of variable speed drive means including means for changing the speed of said drive means operably connected to each of said first and second feeder means and to said plurality of pump means;

(m) a distinct controllable variable speed drive means operably connected to said belt conveyor means;

(n) and a master control means operably connected to said plurality of variable speed drive means and said distinct controllable variable speed drive means, said master control means having means controlling the speed of said plurality of said first and second feeder means and said plurality of pump means in the same speed relationship with respect to said belt conveyor regardless of the speed of said belt conveyor.

4. The structure set forth in claim 2 including:

(p) stirring means disposed above said auger-type conveyors in each of said plurality of second feeder means for breaking up any solid granular formations, said stirring means drivingly coupled to said auger-type conveyor.

5. The structure set forth in claim 2 wherein said first feeder means and said plurality of second feeder means have sides making a converging angle of substantially 30° with a vertical plane.

6. The structure set forth in claim 2 wherein the diameter of said openings in the bottom of said first feeder means and said plurality of second feeder means is approximately 5/6 the diameter of said auger-type conveyors in each of said feeder means.

7. The structure set forth in claim 1 including:

(o) a sand lump scarifier disposed in the opening most downstream at the bottom of said first feeder means for breaking up any green sand lumps.

8. The structure set forth in claim 1 wherein said selective valve means includes:

(q) a solenoid operated valve mechanism adapted to be electrically connected to switch means, and having a fluid inlet and a pair of outlets, said mechanism including a valve permitting flow of sand in either of two actuated positions and stopping the flow of sand in its unactuated position;

(r) a fluid source under pressure connected to the inlet of said solenoid operated valve mechanism;

(s) a fluid actuated cylinder mechanism having a pair of inlets operably connected to the pair of outlets of said solenoid operated valve mechanism and having its piston connected to said valve;

(t) and switch means including an electrical source for applying power to said solenoid operated valve mechanism to operably position said valve.

* * * * *